United States Patent [19]

Vasquez

[11] 4,300,124

[45] Nov. 10, 1981

[54] METHOD OF PROTECTING AN AREA AND CONTROL SYSTEM FOR WATCHMAN TOURS

[76] Inventor: Tulio Vásquez, Cra 15 No. 39-27, Bogotá, Colombia

[21] Appl. No.: 115,138

[22] Filed: Jan. 24, 1980

[51] Int. Cl.[3] ..... G07C 1/20

[52] U.S. Cl. ..... 340/306; 340/309.1; 340/309.5

[58] Field of Search ..... 340/305, 306, 309.1, 340/309.4, 309.5, 312

[56] References Cited

U.S. PATENT DOCUMENTS

| | | | |
|---|---|---|---|
| 3,579,221 | 5/1971 | Ashley | 340/306 |
| 3,736,561 | 5/1973 | Rumpel | 340/306 |
| 3,774,193 | 11/1973 | Restrepo | 340/306 |
| 4,024,527 | 5/1977 | Houghton | 340/306 |

*Primary Examiner*—Alvin H. Waring
*Attorney, Agent, or Firm*—Browdy and Neimark

[57] ABSTRACT

The system includes a number of spaced apart key stations which a watchman is to visit on a tour of an area. A portable unit is provided with two AND circuits. Upon starting a tour, one of the AND circuits sets a number of timers, a first one of the timers starts running providing a signal to a prealarm sound-producing device on the portable unit unless the first timer has been reset by the completion of the second AND circuit by having inserted all of the keys and turning them. At the same time, the first timer starts a second timer running. The second timer provides a delay which allows the watchman a few more minutes to complete his tour. If he fails, a third timer feeds a fault signal to a counter in the portable unit and also triggers a further audible alarm device on the portable unit and at the same time resets all the timers in the portable unit. A coder is provided in the portable unit which provided an output, via a plug and jack arrangement, to a decoder which resets a timer at a base station. Otherwise, this timer will effect the enabling of an audible alarm at the base station indicating either that all keys had not been turned or that the watchman has not returned.

9 Claims, 1 Drawing Figure

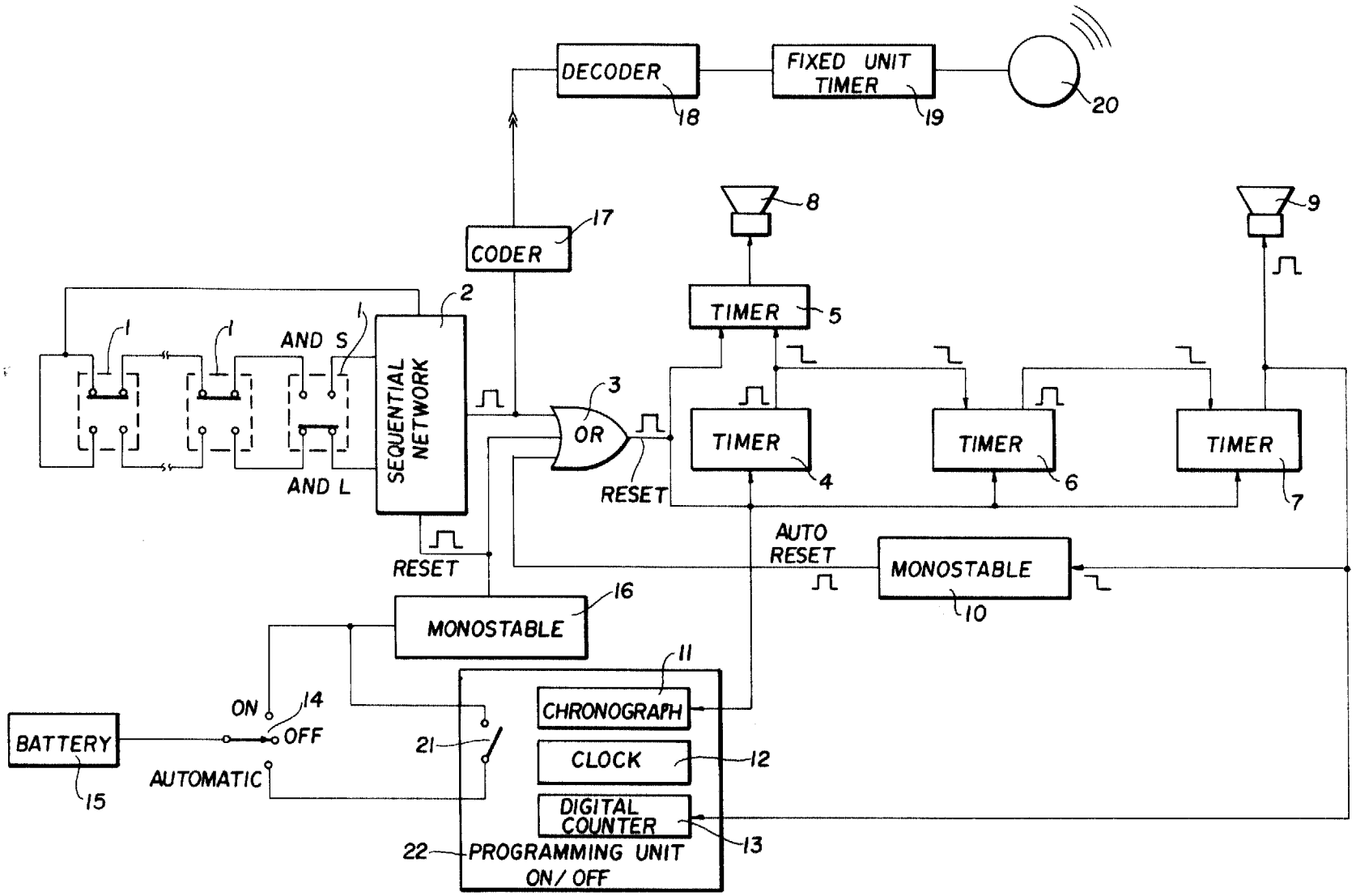
FIXED UNIT TIMER
DECODER
CODER
SEQUENTIAL NETWORK
AND S
AND L
OR
RESET
TIMER
TIMER
TIMER
TIMER
MONOSTABLE
AUTO RESET
MONOSTABLE
RESET
CHRONOGRAPH
CLOCK
DIGITAL COUNTER
PROGRAMMING UNIT ON/OFF
ON
OFF
AUTOMATIC
BATTERY
1
2
3
4
5
6
7
8
9
10
11
12
13
14
15
16
17
18
19
20
21
22

METHOD OF PROTECTING AN AREA AND CONTROL SYSTEM FOR WATCHMAN TOURS

FIELD OF THE INVENTION

The present invention relates to an alarm and register system to control and protect a watchman in his vigilance tours and, more particularly, to such a system which includes a series of fixed keys, each one of them having its corresponding selector switch in a portable unit which will accomplish its function accurately if in one tour all the keys have turned its respective selector switches in the same direction.

BACKGROUND OF THE INVENTION

The U.S. Pat. No. 3,774,193 to Restrepo, teaches that by means of a portable unit which contains a double selector, one to select an internal impedance value which is to be compared, by means of an external plug of the portable unit, with an impedance value contained in a corresponding fixed station; these values, when determined to be equal by means of a comparison using a Wheastone Bridge cause an associated electronic circuit to permit the selector advance to the following position so that a new comparison with the following station and thus successively up to the last station, can take place with which everything is disposed to send a reset singal which upon reception by one of the circuits of the master fixed unit determines that the time accumulated in an adjustable timer of the fixed unit returns to zero, avoiding thus completion of the programmed time in the timer of the master unit, and avoiding thus an alarm which can be activated by the master unit and that the fault be registered in a counter, with the previous activation of a prealarm signal and the succeeding retarded activation of a general alarm.

A second selector in the portable unit is synchronized with the first selector and permits establishing the minimum time which the watchman must employ between one station and the following.

The described system requires a portable unit and a master unit in a fixed place and the alarms due to the nonfulfilment of the watchman in his tour can only be produced in fixed places, frequently not audible by the watchman. Moreover, the control stations require a connector with which good contact may fail as a result of the bad weather, and the water and moisture may vary the external impedance used in comparison, facilitating an erratic functioning. The heavy duty to which the portable units normally are subjected produces frequently the deterioration of the plug and associated cable.

There exist other systems like that disclosed in the U.S. Pat. No. 3,579,221 to Ashley in which a supervisor can monitor the tour followed by the watchman by observing lights in a panel. Such a system is substantially different to the proposed one because, being wireless, requires sending modulated signals of radio frequency.

Other systems such as that of the U.S. Pat. No. 4,024,527 to Houghton, even if they accomplish functions similar to the proposed one, require wiring to provide interconnecton between the control stations and the master control.

SUMMARY OF THE INVENTION

This invention relates to a portable set comprising electrical and electronic means which cooperate together in order that the tour of the watchman can be effected under control in a programmed time and path.

A series of control fixed keys are placed around a building or area to be protected. The watchman carries a portable unit which is programmed to produce an internal signal each time the watchman completes the rotation of all the selector switches by means of the use of the respective fixed keys, all with diffent combination.

A principal timer incorporated in the portable unit is activated when the watchman begins its tour. If the watchman does not return within a predetermined period of time, an alarm is produced in the portable unit. The portable unit which is carried by the watchman must reset the time incorporated only if at the end of the tour all the selector switches have been rotated in the same direction by means of the fixed keys.

A preferred embodiment of the present invention is now summarized. A number of fixed control keys are distributed along the tour of the watchman. Each control key is fixed by means of a chain to a convenient receptacle in the adequate place such as in a hidden recepticle. Each key has a combination which can only be associated with its corresponding selector switch in the portable unit.

A portable unit comprising electrical and electronic means establishes the places which the watchman must visit in a maximum programmend time. The portable unit has a plurality of selector switches, placed so as to be able to actuate them from the exterior of the portable unit, each one can only be rotated by the corresponding respective fixed control key. In the first tour, by way of example, the watchman will begin to rotate clockwise each of the selector switches; the logic sequence is that he proceeds from the first, in orderly ascending sequential fashion up to the last; when he actuates the selector switch corresponding to the last fixed key or he turns the last selector switch in the energizing direction, notwithstanding that he had proceeded in any order, a signal is produced causing the timer to be reset. As explained above, the portable unit is provided with a timer which can be adjusted internally to fix the maximum time that the watchman must take for the whole tour. In any way, due to lack of care or any other reason, if the watchman does not arrive to activate the reset signal within a programmed time period, thirty minutes for example, a prealarm signal of low intensity is produced by the portable unit, during ten seconds for example, indicating to him that the time to complete the tour is near to finish. If after the prealarm signal, the reset signal is not produced between an additional time, three minutes for example, an audible alarm of sufficient intensity will be activated in the portable unit and simultaneously a counter in the interior of the portable unit must register a failure.

A control fixed unit in the area to be protected has a timer adjusted with a time greater than that of the alarm of the portable unit, ten minutes more for example. The timer of the fixed unit receives the reset signal from the portable unit by means of an adequate transmission arrangement such as a plug and jack, the signal effects the resetting of the timer of the fixed unit, avoiding that in normal conditions the timer of the fixed unit produces a general alarm, indicating thus an emergency condition.

The sole FIGURE is a block diagram of an exemplary embodiment of a control system, according to the present invention, showing in detail the constitution and connection of the selector switches.

DETAILED DESCRIPTION OF THE PREFERRED EMBODIMENT

This invention relates to a portable unit which includes electrical and electronic means which cooperate to achieve as a result that a tour of vigilance is realized during a previously determined time.

The portable unit has a plurality of key selector switches 1 of opposite poles, which can be rotated from the exterior by means of the respective keys which are to be placed in a conventional fashion with fixed chains in the places that the watchman must visit. As illustrated, three switches 1 are shown, two being shown in one position while the other is shown in it second position where it is placed by operation of one of the keys.

The set of selector swtiches 1 with the shown possible connections permits the completion of two circuits of condition AND, that is circuit S and L. By way of example, the AND circuit S is formed when all the selector switches 1 are rotated to the right and circuit the AND L when all the selector switches 1 are rotated to the left.

The set of selector switches, 1 without limitation in number, conforms the equivalent to a SPDT switch. The AND S circuit and the AND L circuit and the common lead thereof are connected to a sequential network 2, which produces a reset pulse each time that an AND conformed corresponds to the enabled input of the sequential network, at the same time that this sequential network disenables the input of the AND circuit S and enables the input of the AND circuit L.

Thus, the watchman, to get another reset pulse is forced to visit all key stations and use all the control keys in order to turn all the selector switches 1 to the left completing the AND circuit L which having its input enabled produces the reset pulse and disenables the input to the AND circuit L and enables the input to the AND circuit S.

An electronic timer 4 can be adjusted to determine the maximum time of the vigilance tour, for example 30 minutes.

When the equipment is turned on either by a manual switch 14 or a gate, shown diagrammatically as switch 21 of an automatic programming unit 22, the connection of a battery, 15 to a monostable circuit 16 produces a pulse from the monostable circuit 16, which pulse is applied to the sequential network 2, enabling the AND circuit S to provide unifomity in the direction of rotation of selector switches for the first tour. The pulse is also applied to an OR gate 3, which sends a reset signal to timers 4, 5, 6, 7 and to the chronograph 11; of the programmed unit 22 the timer 4 passes to its high state each time that the sequential network 2 in association with the AND circuit S and L produces a reset signal, the timer 4 returns to zero time and maintains its high state.

If in a given cycle the timer 4 is not reset opportunely within its period, for example before the elapse 30 minutes, it falls to its low state triggering the timer 5 which during 10 seconds activates a prealarm signal 8 and simultaneously the timer 4 triggers the timer 6, which remains in its high state during three minutes and upon expiration of three minutes goes to its low state and triggers the timer 7, which upon being triggered will cause a digital counter 13 of the programming unit 22 to sum a unit, registering, the fault of the watchman. The timer 7 will remain in its high state for 30 seconds; while it remains in high state, the alarm 9 will be energized and sounding and, on expiraion of the 30 seconds by means of a monostable circuit 10, produces an automatic reset signal which is applied to a third input to the OR gate 3, producing thus the reseting of all the timers 4–7 and the chronograph 11.

The programming unit 22 has as its function to command automatically the on and off of the portable system and has as auxiliary elements a clock 12 and a chronogrph 11, the members, 11, 12 and 13 each include a respective display which may be either or, may all be observed by pressing a single MODE pushbottom.

The fixed unit consisting of a decoder 18, a timer 19 and an alarm 20 and has as its function producing a general alarm in case that, having passed a prudential time after the alarm in the portable unit has been produced, a reset signal from the sequential network has not been produced. This prudential time is obtained by programming a time. For the timer 19, about 10 minutes greater than that of the timer 4.

All the above-mentioned times have an exclusive Character of illustration.

Once the reset signal is produced by the sequential network, in addition to the OR gate 3, it is applied to a coder 17; the signal of the coder 17 is fed to the decoder 18 by means of a plug on the portable unit, and a jack placed besides the last key station of the tour. The watchman, before turning this last key, is to insert the plug in the jack, which permits, when the reset signal is produced by the sequential network, with exclusion of the autoreset, the timer 19 to remain in its reset state avoiding energizing of the alarm 20 and thus the production of sound therefrom.

It is evident for the skilled in the art that some changes and additions may be introduced, since a preferred embodiment of the invention has been presented. As an example, the sequential network may be commanded by singal pole switches in such a way that when they are closed they all constitute the condition one, and when they are opened insert resistances which would produce the condition zero when a certain value of resistance is obtained.

By means of a convenient further sequential network in conjuction with an additional timer and resistances of different value associated to each of the selector switches, an obligated sequential tour for the watchman can be obtained and a minimum variable time between stations.

The sending of the resetting signal to the fixed unit may also be via radio.

I claim:

1. An alarm apparatus comprising:

a plurality of fixed control keys with different combinations therebetween;

a portable control unit having a plurality of key selector switches, said selector switches being equal in number to said plurality of fixed keys and each respective one of said fixed keys corresponding to a corresponding respective one of said selectro switches;

a central unit having control means and alarm means operatively associated therewith to provide an alarm if an appropriate signal is not received within predetermined time period; and control devices in said portable control unit which cooperate with said control means in said central unit for triggering an alarm in said portable control unit and then said alarm means in said central unit, if said appropriate signal is not produced in said portable unit within a prederermined time period, said devices in said portable unit including a signalling device which provides the appropiated signal to said portable unit and to said central control unit only when all of said fixed keys have changed all the said selector switches to a given position.

2. An alarm apparatus according to claim 1, wherein said control devices include means for determining if all of said selector switches have been rotated in a given direction.

3. An alarm apparatus according with claim 2, wherein said means for determiniing include at least one timing device which establishes maximum time of a given tour.

4. An alarm apparatus according to claim 3, wherein said at least one timing device includes an adjustable means for establishing the maximum time of the tour, a second timing device to limit a time period of sounding of a prealarm signal, a third timing device to establish a time period between the prealarm signal and an alarm signal, and a fourth timing device to establish a time period of sounding of an alarm.

5. An alarm apparatus according to claim 3 or 4, wherein said control devices in said portable unit include a switch to connect and disconnect said at least one timing device.

6. An alarm apparatus according to claim 1, wherein each of said fixed keys activate a corresponding one of said selector switches of said portable unit, a first AND circuit is coupled to said selector switches and responds when all of said selector switches are in one of their positions and another AND circuit is coupled to said selector switches and responds when all of said lecector switches are in another of their positions, and an associated sequential network coupled to said AND circuits for producing a reset signal when a given output disappears from one of said AND circuit and appears from the other of said AND circuits.

7. An alarm apparatus according to claim 1, wherein said portable unit has a plug which, when inserted in a jack connected to said central unit erases time accumulated in a timing device of said central unit, said appropriate signal having been produced in said portable unit, codified in said portable unit and decodified in said central unit.

8. An alarm apparatus according to claim 1, wherein said control devices in said portable control unit include means for producing a prealarm signal, and timing means to trigger a second alarm, and wherein said central unit includes means for producing a third general alarm signal when the appropriate signal is not produced in said portable unit within a period of time determined by at least said timing means.

9. A method of protecting an area, comprising the steps of:

(a) starting two predetermined time periods running, one in a portable control unit and a longer one in a central control unit;

(b) triggering respective alarms, upon expiration pf these respective periods, in the portable unit and the central unit provided that an appropiated signal has not appeared before expiration of said time periods;

(c) moving key selector switches in the portable unit to a given position within a given period to produce said appropiate signal which is to erase accumulated time of said two predetermined periods from timing devices; and (d) connecting, via plug jack means, the portable unit with the central unit to feed said appropriate signal thereto and to erase accumulated time of the two predetermined periods from the timing devices in the portable unit and in the central unit.

* * * * *